United States Patent [19]

Tange

[11] 4,043,363

[45] Aug. 23, 1977

[54] BINDING DEVICE FOR BUNDLING OPENINGS OF BAGS OR THE LIKE

[76] Inventor: Fumiko Tange, 39-231, Aza Takane, Oaza Okehazama, Arimatsu-cho, Midori, Nagoya, Japan

[21] Appl. No.: 747,688

[22] Filed: Dec. 6, 1976

[30] Foreign Application Priority Data

Dec. 11, 1975 Japan ..... 50-148099

[51] Int. Cl.[2] ..... B21F 15/04

[52] U.S. Cl. ..... 140/93 A; 53/135; 100/10

[58] Field of Search ..... 140/93 A, 93.6, 115, 140/149; 53/134, 135; 100/8, 10, 33 R

[56] References Cited

U.S. PATENT DOCUMENTS 3,354,915 11/1967 Johnson et al. ..... 140/93 A 3,919,829 11/1975 Burford et al. ..... 53/135

*Primary Examiner*—Lowell A. Larson

[57] ABSTRACT

A binding device for bundling the openings of bags or other material to be bound which comprises: a slidable plate fitted on a vertical support plate; a reel carrying a bundling material such as wire; a feeding mechanism delivering the bundling material; U-shaped carriers attached on rocking arms for supporting the open end of a material to be bound; a movable winding arm for guiding and winding the bundling material round the open end of the material to be bound; and a twisting mechanism for twisting the cut ends of the bundling material that is wound round the material to be bound.

4 Claims, 11 Drawing Figures

BINDING DEVICE FOR BUNDLING OPENINGS OF BAGS OR THE LIKE

BACKGROUND OF THE INVENTION

This invention relates to a binding device for bundling the openings of bags or other materials.

A large variety of bags made of paper, plastic films, netting and the like are hitherto widely used for putting various things into them, and the openings of the bags are closed or bundled in several manners. When the opening of a bag is closed with a piece of bundling material such as steel wire or wire-carrying tape, the bundling material is wound round a portion below the opening hem of the bag and the bundling material is then only twisted with fingers for fastening. Meanwhile, automatic binding devices that are presently available can be used for binding with only special kinds of strings or cords, however, the bundling material such as iron wire or other metallic wire can not be applied to the conventional binding device since they are hardly twisted or tied by such binding device so as to attain satisfactory binding.

BRIEF SUMMARY OF THE INVENTION

It is therefore an object of the invention to provide a novel binding device which is free from the above-described disadvantages.

Another object of the invention is to provide a binding device for firmly and reliably bundling bags and other materials with wires or wire-carrying tapes.

A further object of the invention is to provide a binding device of the type described which is compact and handy enough to be used easily and widely for bundling several bags and other materials.

Still a further object of the invention is to provide a binding device which is simple in structure enough to be easily produced and be free from any troubles over long term use.

In accordance with the present invention pursuant to the above objects, a bundling material such as wire is let out for a necessary length and cut off by a cutting blade. The cut bundling material is then wound by a winding arm round the material to be bound such as the open end of a bag that is held in U-shaped carriers. The U-shaped carriers are movably supported by a pair of rocking arms pivoted to a slidable plate. The bundling material wound round the material to be bound is then twisted by a twisting mechanisms which grasps the free ends of the bundling material, thereby the opening of the material to be bound being closed and bound. In the retraction of the winding arm, a certain length of the bundling material is fed from a reel through the twisting mechanism to the U-shaped carriers by a feeding mechanism, thus the binding device becomes ready for the next operation. The above movements of the binding device of the invention can be performed sequentially and automatically.

BRIEF DESCRIPTION OF THE DRAWINGS

The nature, principle and details of the invention will be more clearly apparent from the following detailed description with respect to the preferred embodiment of the invention with the accompanying drawings, in which.

DETAILED DESCRIPTION OF THE PREFERRED EMBODIMENT

Referring now to the accompanying drawings, the embodiment of the binding device for bundling bags or the like will be described.

Figure 1:
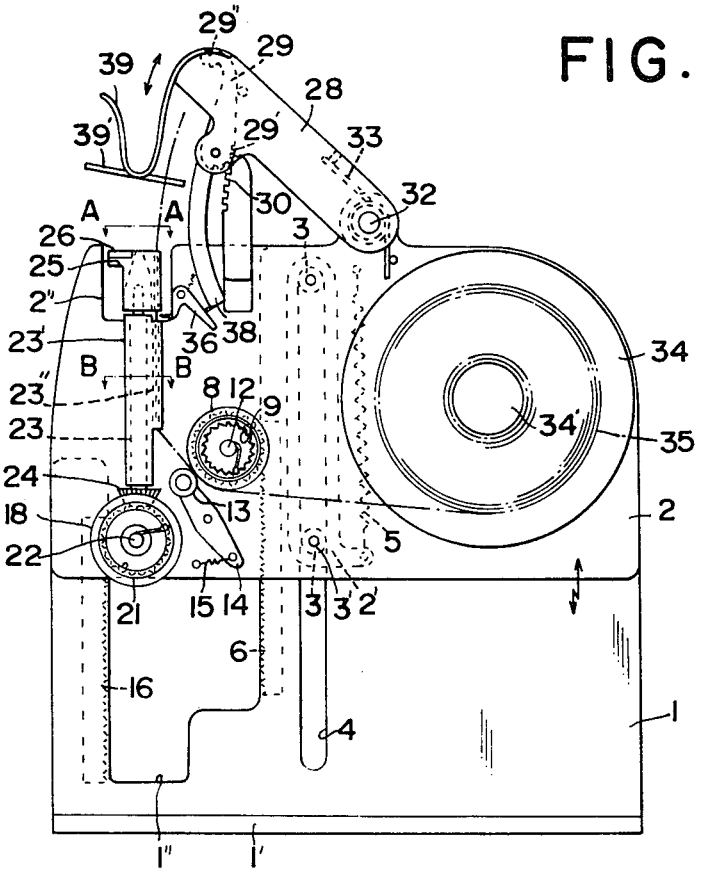
FIG. 1 is a front elevation of the embodiment of the present invention.
Figure 2:
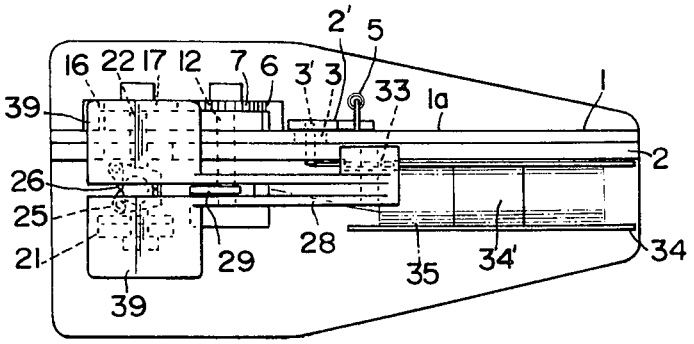
FIG. 2 is a plan view of the embodiment.

A vertical support plate 1 is vertically set up on a horizontal bed plate 1' and a slidable plate 2 is fitted to one side of the support plate 1 in the manner that the slidable plate 2 is movable in vertical directions. A pair of rollers 3 are pivotally secured to the slidable plate 2 with the respective pins 3' and are guided by a vertical slot 4 formed in the vertical support plate 1. The protruding ends of the pins 3' on the rear side 1*a* of the support plate 1 are provided with a cover plate 2', so that the vertical support plate 1 is held between the slidable plate 2 and the cover plate 2'. A spring 5 is attached between the upper portion of the rear side 1*a* of the vertical support plate 1 and the lower end of the cover plate 2' and with this spring 5, the slidable plate 2 is always urged upward. A guide opening 1'' is formed in one side portion of the support plate 1 and a rack 6 is formed along one side edge of the guide opening 1''. As shown in FIG. 2, the rack 6 is protruded from the rear side surface 1*a* of the support plate 1. A delivery roller 8 having peripheral knurled grooves is attached to the slidable plate 2 with a shaft 12 and the other side of the shaft 12 is further provided with a pinion 7 that engages with the rack 6. The rotation of the pinion 7 is transmitted through the shaft 12 and it causes the engagement between a ratchet tooth 9 and a ratchet pawl 9' within a transmission housing 11 provided on the side of the delivery roller 8 when the slidable plate 2 is raised, and the delivery roller 8 is also rotated by this engagement. The numeral 10 denotes a spring attached to the ratchet pawl 9' and the spring 10 is also fixed to the shaft 12. The delivery roller 8 is brought into contact with a supporting roller 13 that is pivoted to an arm 14. A spring 15 is attched to the lower end of the arm 14 so that the supporting roller 13 at the other end of the arm 14 is always urged toward the delivery roller 8. The bundling material 35 such as wire that is wound on the reel 34 supported on the slidable plate 2 is thus pinched and delivered by the rollers 8 and 13.

Another rack 16 is attached in opposed relation to the above-mentioned rack 6. Engaged with the rack 16 is a pinion 17 that is held by a shaft 22. A transmission housing 21 having a bevel gear 18 is rotatably fitted to the shaft 22 and the rotation of the pinion 17 is transmitted by the engagement of a projection 18' fromed in the transmission housing 21 with a pawl 19 at the end of a spring 20 projected from the shaft 22. The transmission in this case is effected only when the slidable plate 2 is moved down to rotate another bevel gear 24 that is meshed with the former bevel gear 18. Vertically attached to the bevel gear 24 is a rotary shaft 23 for twisting the bundling material 35 and the upper side of the shaft 23 is held by a stationary bearing 23' having on one side thereof a through hole 23'' for passing the bundling material 35. The top end of the shaft 23 is provided with a supporting member 25 that is positioned within a guiding recess 2''. This supporting member 25 has a pair of supporting pawls 26 on its front side and the free ends of the supporting pawls 26 are urged toward the center of the opening 25'' by the force of springs 27 that are attached to the pivotal ends of the pawls 26. The side opposite to the pawls 26 is provided with a vertical aperture 25' which corresponds to the above-mentioned through hole 23''.

The upper edge of the slidable plate 2 has a shaft 32 to which a pair of rocking arms 28 are pivotally secured. The free ends of the arms 28 are provided with U-shaped carriers 39 which receive the opening end of the material to be bound *a*. On the under surface of a U-shaped carrier 39 on one side, a depressing piece 39' is attached. A movable winding arm 29 having a bent hook portion 29'' for catching the bundling material 35 is attached in the middle gap 28' between both rocking arms 28. The lower pivoted end of the winding arm 29 is provided with a sector gear 29' which engages with a rack 30 projected from the upper side of the slidable plate 30, thus the sector gear 29' is moved with the turning of the rocking arms 28. The pivoted portion of the rocking arms 28 is provided with a spring 33, with which the rocking arms 28 are always urged upward.

On one side surface of the slidable plate 2, a reel 34 is attached with a reel shaft 34'. The bundling material 35 such as wire, wire-carrying tape or the like is wound round the reel 34. Attached below the lower pivoted end of the winding arm 29 is an arcuate push rod 38 which pushes the rear portion of a cutting blade 36. The middle portion of the cutting blade 36 is attached to the slidable plate 2 with a pin 37 and the lower portion of the push rod 38 is brought into contact with the cutting blade 36. When the push rod 38 is moved down, it causes the cutting blade 36 to turn, so that the bundling material 35 that is passed out of the through hole 23'' of the bearing 23' can be cut by the tip edge of the cutting blade 36. By the way, the numeral 36' indicates a spring which releases the cutting blade 36 after the cutting.

In the following, the operation of the above binding device of the invention will be described in detail.

In the first place, the free end of the bundling material 35 that is held on the reel 34 attached to the vertically slidable plate 2, is pinched between the delivery roller 8 and the supporting roller 13, the tip end of the bundling material 35 is then passed through the through hole 23'' formed in one side portion of the bearing 23', and the bundling material 35 is further led to the lower portion of the hook 29'' of the winding arm 29 by way of the aperture 25' of the supporting member 25.

Figure 3:
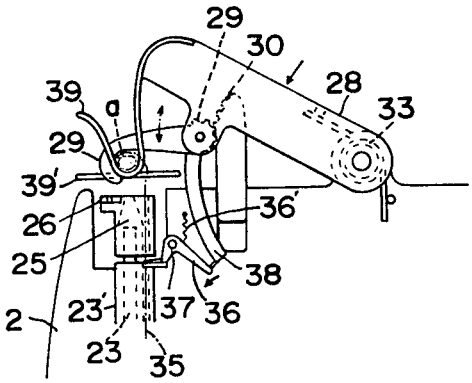
FIG. 3 is a partial front view of the embodiment showing the state of binding.

In the next step, the open end portion of the material to be bound *a* is fitted to the U-shaped carriers 39 formed at the free ends of the rocking arms 28. When the rocking arms 28 are pressed down, they are turned on the fulcrum of the shaft 32 against the force of the spring 33, at the same time, the sector gear 29' of the winding arm 29 which is attached to the middle portions of the rocking arms 28 is rotated by the engagement with the fixed rack 30. Therefore, the winding arm 29 is also turned, and with this movement, the bundling material 35 carried by the hook 29'' is wound round the open end portion of the material to be bound *a* that is held in the U-shaped carriers 39 (see FIG. 3).

With the downward movement of the rocking arms 28, the integrally attached arcuate push rod 38 is also lowered and the lower end of the push rod 38 pushes the end portion of the cutting blade 36, so that the cutting blade 36 is turned around the fulcrum of the pin 37 and the tip edge of the blade 36 is moved toward the twisting mechanism. Thus the vertically suspended bundling material 35 is pressed and cut by the edge of the cutting blade 36.

Figure 4:
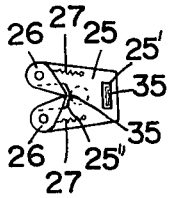
FIG. 4 is a plan view of a supporting member taken on the line A—A in FIG. 1.
Figure 5:
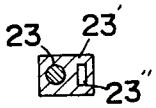
FIG. 5 is a cross-sectional view of a stationary bearing taken on the line B—B in FIG. 1.
Figure 6:
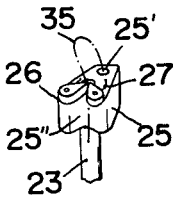
FIG. 6 is a perspective view of the supporting member.
Figure 7:
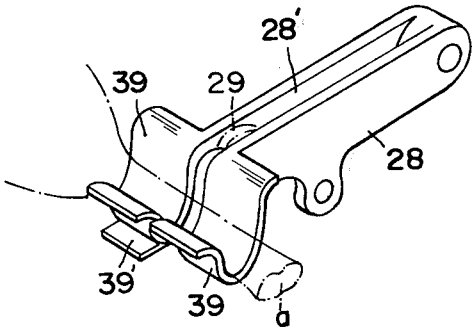
FIG. 7 is a perspective view of a rocking arm.
Figure 8:
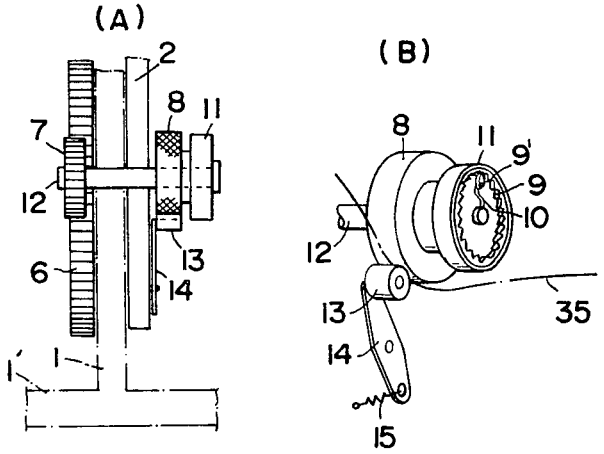
FIGS. 8 (A) and 8 (B) are a side view and a perspective view of a feeding mechanism.
Figure 9:
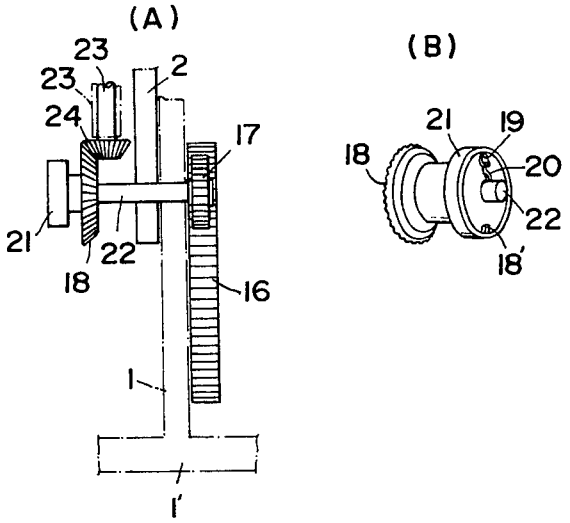
FIGS. 9 (A) and 9 (B) are a side view and a perspective view of a transmitting mechanism.

In this operation, when the depressing piece 39' attached on the under side of the U-shaped carrier 39 on one side is caused to run against the upper surface of the slidable plate 2, the slidable plate 2 is slid down on a wall surface of the vertical support plate 1 since the rollers 3 are guided in the slot 4 of the support plate 1. When the slidable plate 2 is moved down, the pinion 17 on the side wall of the slidable plate 2 is rotated by the engagement with the rack 16 formed on the side wall of the vertical support plate 1. Thus the bevel gear 18 fitted to the shaft 22 of the pinion 17 is rotated and the other bevel gear 24 engaged with the former bevel gear 18 is also rotated. With this rotation of the bevel gear 24, the supporting member 25 of the twisting mechanism attached to the top end of the rotary shaft 23 is rotated several times as required. In this operation, the lower portion of the bundling material 35 that is passed through the aperture 25' of the supporting member 25 has been cut off by the cutting blade 36 and the tip end of the bundling material 35 has been caught within the supporting pawls 26 by the swing action of the winding arm 29 and held in the middle opening 25'' (see FIGS. 4 and 6). Thus the ends of the bundling material 35 of a certain length can be twisted several times under the open end portion of the material to be bound *a*.

In the next step, when the binding operation for the material to be bound *a* is completed, the material *a* is taken off from the U-shaped carrier 39 to release the depressing to the rocking arms 28. The slidable plate 2 which has been pushed down by the rocking arms 28 is thus moved upward to the original position by the force of the spring 5 attached between the cover plate 2' and the support plate 1. In this operation, the pinion 17 on the shaft 22 engages with the rack 16, however, the engagement between the pawl 19 and the projection 18' in the transmission housing 21 near the bevel gear 18 is released (they are engaged only when the slidable plate 2 is moved down), so that the idle rotation of the pinion 17 is caused to occur. Therefore, the twisting mechanism is not rotated in this operation.

Meanwhile, when the slidable plate 2 is moved upward, the pawl 9' engages with the ratchet teeth 9 in the transmission housing 11 that is formed on the side of the delivery roller 8 fitted to the shaft 12 of the pinion 7 being in engagement with the rack 6, so that the delivery roller 8 is rotated by the working of the transmission housing 11 (when the slidable plate 2 is moved down, the engagement of the ratchet teeth 9 with the pawl 9' is released and the delivery mechanism is not worked). With the rotation of the pinion 7, the delivery roller 8 is rotated and the bundling material 35 from the reel 34 is advanced in proportion to the rotation of the roller 8. The forward end of the advanced bundling material 35 passes through the aperture 25' of the supporting member 25 of the twisting mechanism and it reaches the hook portion 29'' of the winding arm 29 on the rocking arms 28 which is returned to the original position. In the upward returning of the rocking arms 28, since the sector gear 29' at the pivoted end of the winding arm 29 is rotated in the direction reverse to the aforementioned action by the engagement with the rack 30, the hook portion 29'' is returned and received into the space between the free ends of the rocking arms 28 that support the U-shaped carriers 39. Simultaneously with the upward motion of the rocking arms 28, the push rod 38 for the cutting blade 36 is also raised to release the pressure to the cutting blade 36 and accordingly, the cutting blade 36 is turned by the force of the spring 36' to retract the edge from the passage of the bundling material 35. Therefore, the next advancing of the bundling material 35 is not hindered at all.

As disclosed above, the vertically movable slidable plate that is fitted to the side surface of the vertical support plate of the binding device, is provided with a feeding mechanism for delivering iron wire or other wire-carrying bundling material, rocking arms for moving the slidable plate and having a winding arm to wind the bundling material round the material to be bound, and a cutting blade being interlocked with the turning of the rocking arms and positioned near the supporting member of a twisting mechanism that is attached in front of the feeding mechanism. Thus, only by applying the opening portion of a plastic film bag, a net bag or other material to be bound into the U-shaped carriers on the free end of the rocking arms and by depressing them, the delivered bundling material of a certain length can be cut off, and at the same time, it is wound round the material to be bound, further, both the ends of cut bundling material are caught and automatically twisted together by the twisting mechanism.

Therefore, the operation of the binding device of the present invention is quite easy and there is no necessity for the device to move or advance the bundling material since the bundling material is automatically delivered for a certain length by the rotation of a delivery roller of the feeding mechanism and it is then led under the winding arm attached at the free ends of the rocking arms. In addition to the above, the structure of the binding device of the invention is very simple so that the device can be made compact and lightweight which fact facilitates the handling and transporting of the binding device. Furthermore, the binding device of the invention is durable for long term use without substantial troubles and damages, therefore, the efficiency of binding work can be very much improved.

Although the present invention has been described in connection with the preferred embodiment thereof, many variations and modifications will now become apparent to those skilled in the art. It is preferred, therefore, that the present invention be limited not by the specific disclosure herein, but only by the appended claims.

What is claimed is:

1. A binding device for bundling the openings of bags or the like which comprises: a vertically movable slidable plate which is fitted on a vertical support plate set up on a bed plate; a reel supporting a bundling material such as iron wire or wire-carrying cord and being attached to one side portion of said slidable plate; a feeding mechanism delivering said bundling material and being formed in the other side portion of said slidable plate; a twisting mechanism positioned in front of said feeding mechanism, said twisting mechanism holding said bundling material with supporting pawls and twisting said bundling material when said slidable plate is moved down; rocking arms the root ends of which are pivoted to the upper portion of said slidable plate above said twisting mechanism; U-shaped carriers attached to the free ends of said rocking arms to receive the material to be bound; a movable winding arm attached in the middle gap between said rocking arms, said winding arm guiding and winding said bundling material; a rack projected from said slidable plate and engaged with a sector gear formed at the pivoted end of said winding arm to rotate said winding arm; and an arcuate push rod attached at the lower portions of said rocking arms, the lower end of said push rod being in engagement with a cutting blade which is attached to the side of a supporting member attached to the upper end of said twisting mechanism; and said device being characterized in that a certain length of said bundling material delivered to said twisting mechanism is cut off by said cutting blade interlocked with the movement of said rocking arms when material to be bound in said U-shaped carriers is moved down, and with the pushing down of the upper side of said twisting mechanism, said slidable plate is moved down and in interlocked relation with the lowering of said slidable plate, said twisting mechanism is rotated, thereby said bundling material wound by said winding arm being twisted to bundle said material to be bound.

2. A binding device as claimed in claim 1 wherein said feeding mechanism for delivering said bundling material and attached on said slidable plate is provided with a supporting roller and a delivery roller having a ratchet mechanism which is fixed to the shaft of the pinion engaged with a vertical rack formed on the vertical support plate.

3. A binding device as claimed in claim 1 wherein said twisting mechanism for twisting said bundling material and attached on said slidable plate is provided with a bevel gear which is engaged with another bevel gear attached to the lower end of a twisting shaft fixed to a supporting member having supporting pawls, said former bevel gear being intermittently rotated through a transmission housing which is attached to the shaft of a pinion engaging with another vertical rack formed on said vertical support plate.

4. A binding device as claimed in claim 1 wherein said slidable plate is vertically guided by rollers which are attached to one side surface of said slidable plate and engaged with a vertical slot formed in said vertical support plate.

* * * * *